United States Patent [19]

Tavernier

[11] 4,422,796

[45] Dec. 27, 1983

[54] HYDRAULICALLY ADJUSTABLE PAVEMENT ROLLER

[76] Inventor: Boyd D. Tavernier, P.O. Box 11915, Reno, Nev. 89510

[21] Appl. No.: 278,324

[22] Filed: Jun. 29, 1981

Related U.S. Application Data

[63] Continuation of Ser. No. 120,640, Feb. 11, 1980, abandoned.

[51] Int. Cl.[3] ..... E01C 19/26

[52] U.S. Cl. ..... 404/128; 172/170; 172/254; 172/483; 172/662; 180/20; 404/127

[58] Field of Search ..... 404/128, 126, 123, 122, 404/127; 172/170, 254, 483, 662, 464, 476, 739; 180/20

[56] References Cited

U.S. PATENT DOCUMENTS

| | | | |
|---|---|---|---|
| 805,807 | 11/1905 | Moser | 404/128 |
| 1,631,271 | 6/1927 | Keeler | 404/127 |
| 2,120,745 | 6/1938 | Greiner et al. | 404/128 X |
| 2,127,485 | 8/1938 | Owens et al. | 404/123 |
| 2,673,434 | 3/1954 | Babinchak | 172/739 X |
| 3,146,686 | 9/1964 | Grace et al. | 404/127 |
| 3,291,013 | 12/1966 | Stolp | 404/128 |
| 3,993,413 | 11/1976 | Cox et al. | 404/128 |
| 4,193,710 | 3/1980 | Pietrowski | 404/128 |

FOREIGN PATENT DOCUMENTS

| | | | |
|---|---|---|---|
| 1534363 | 8/1969 | Fed. Rep. of Germany | 404/127 |
| 2254733 | 5/1974 | Fed. Rep. of Germany | 404/127 |
| 934932 | 8/1963 | United Kingdom | 404/122 |

*Primary Examiner*—Rodney H. Bonck
*Attorney, Agent, or Firm*—Linval B. Castle

[57] ABSTRACT

A small roller attached to a conventional power-driven paving roller or the like is hydraulically positionable to roll a surface outside of the normal rolling track of the power roller, such as against a building, high curbing, or the like.

6 Claims, 7 Drawing Figures

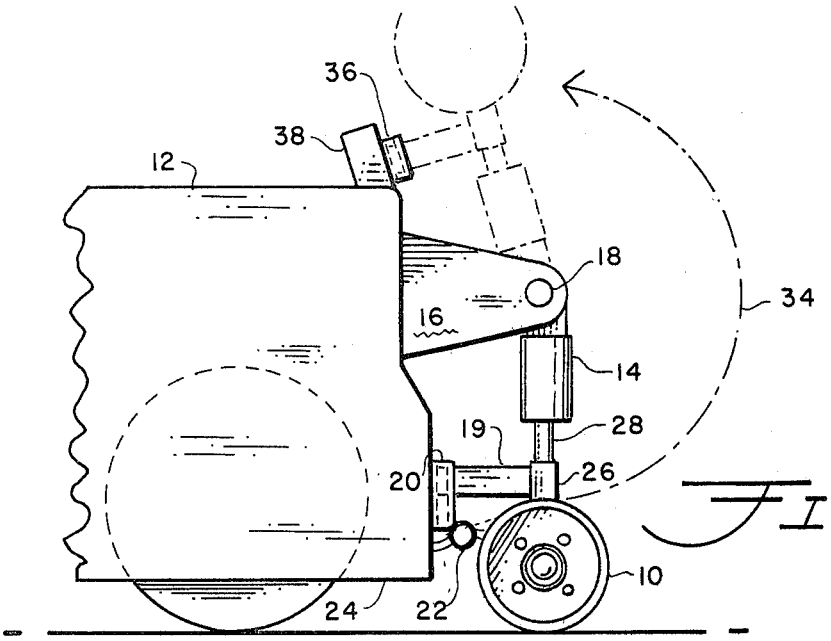
FIG. 1.
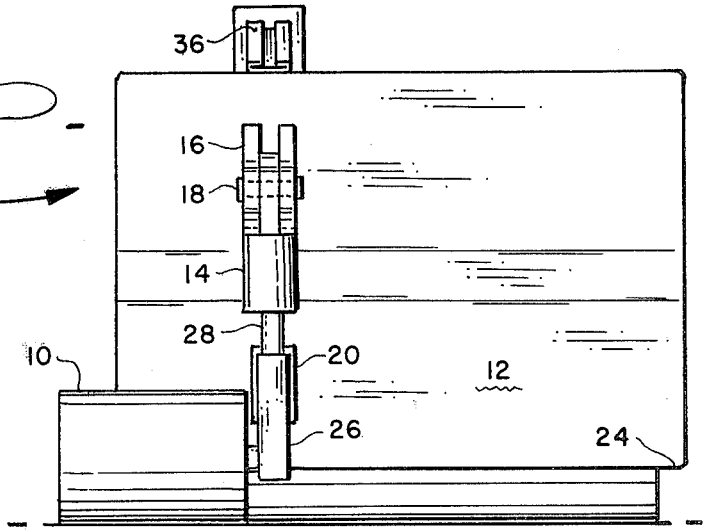
FIG. 2.
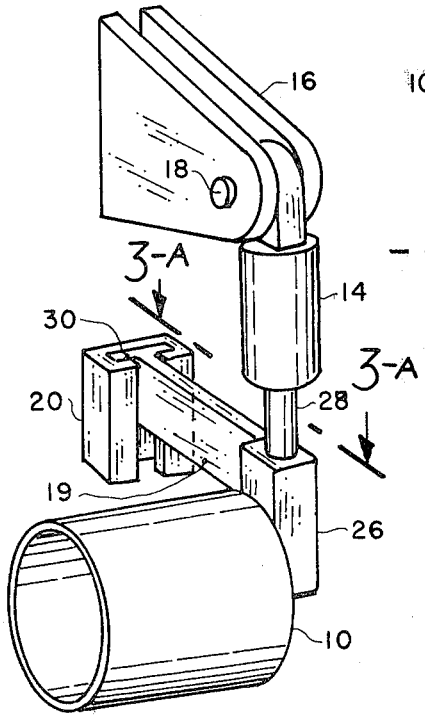
FIG. 3.
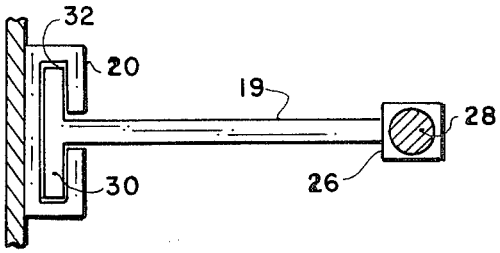
FIG. 3-A.

FIG. 4.
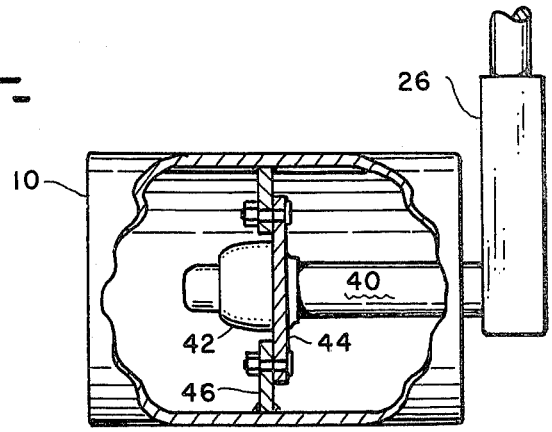
FIG. 5.
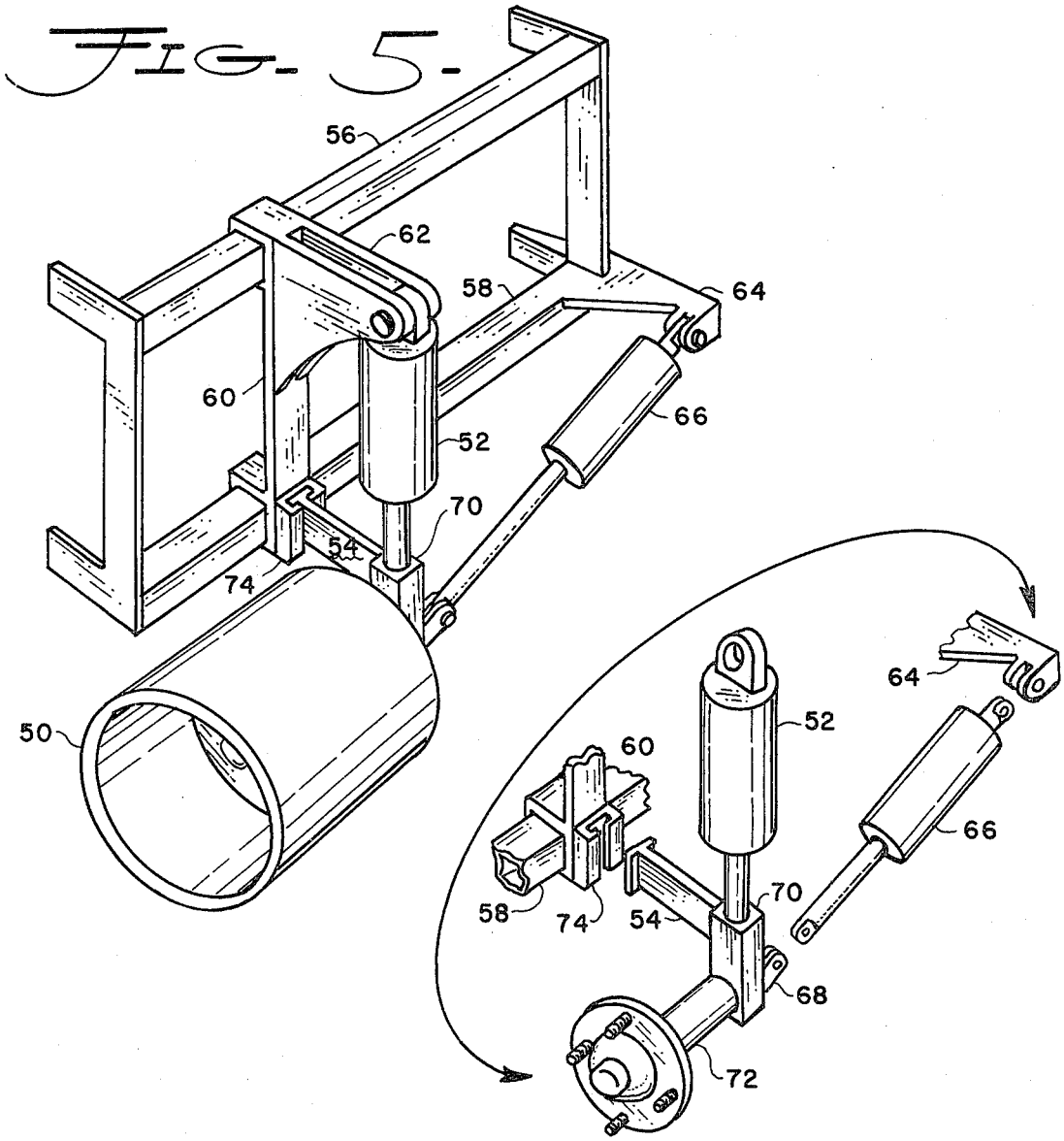
FIG. 6.

HYDRAULICALLY ADJUSTABLE PAVEMENT ROLLER

This application is a continuation of application Ser. No. 120,640, filed Feb. 11, 1980 and now abandoned.

BRIEF SUMMARY OF THE INVENTION

This invention relates to construction machinery and particularly to a small auxiliary roller that may be attached to a conventional power roller and which is hydraulically maneuverable to roll an area outside of the rolling track of the power roller.

Conventional rollers such as pavement rollers used in road building include a large heavy roller that is supported on an axle, the ends of which are journalled to a heavy frame. In most rollers the frame is covered with a steel skirt that provides both protection of the roller drive chain or drive gears and also protection against injuries to nearby workers from the moving drive mechanism.

It is often necessary to roll a surface up to the edge of a building or to a curbing that is higher than the lower edge of the roller skirt. The skirt, which extends outward perhaps eight inches beyond the side edge of the roller track, will prevent the roller from working close to this curb. Further, the roller frame and roller axle bearing will prevent the roller from being used within approximately six to eight inches of a vertical wall or a building. Accordingly it has heretofore been necessary to roll as closely as possible to the vertical obstruction with the conventional power roller and then complete the rolling operation with hand rollers or hand tampers.

The present invention is for an auxiliary roller that is attachable to a truck or a conventional power roller or the like and which is hydraulically maneuverable to roll a surface up against a vertical obstruction, such as a wall or the like.

Briefly described, the auxiliary roller is journalled to a short axle, one end of which is coupled to a support member which is hydraulically driven in a vertical direction. The mounting member is coupled through a hydraulic cylinder to brackets that may be attached to the end of a conventional power roller and is positioned so that the outboard end of the auxiliary roller extends beyond the skirt of the power roller so that, in operation, the auxiliary roller contacts a surface outside of the normal rolling track of the power roller.

DESCRIPTION OF THE DRAWINGS

In the drawings which illustrate a preferred embodiment of the invention:

FIG. 1 is a side elevation view of a portion of a power roller illustrating a typical attachment of the auxiliary roller;

FIG. 2 is an end elevation view of the power and auxiliary roller of FIG. 1;

FIG. 3 is a perspective view illustrating the auxiliary roller and its associated support structure;

FIG. 3-A is a top elevation view taken along the lines 3-A of FIG. 3;

FIG. 4 is a sectional view of the auxiliary roller;

FIG. 5 illustrates the auxiliary roller supported on a support structure that provides both vertical and horizontal adjustment of the roller; and FIG. 6 is a perspective view illustrating in better detail the support mechanism of the embodiment illustrated in FIG. 5.

DETAILED DESCRIPTION OF THE PREFERRED EMBODIMENT

In the elevation view of FIG. 1, the auxiliary roller 10 of the invention is illustrated in its working position at the end of a power roller 12. The axle of the auxiliary roller 10 is coupled to the piston of a hydraulic cylinder 14, the opposite end of which is pivotally connected to a support bracket 16 welded or otherwise connected to the end of the power roller 12. To prevent rotation about the pivot bolt 18 that intercouples the cylinder 14 and support bracket 16, the auxiliary roller 10 is coupled through a sliding bracket 19 to a socket 20 that is attached to the rear end of the power roller 12 and which will be subsequently described in greater detail. If desired, a coolant pipe 22 may be brought from the power roller 12 and positioned to spray the surface of the auxiliary roller 10.

FIG. 2 is an end elevation view of the power roller 12 with the attached auxiliary roller 10 and illustrates how the auxiliary roller 10 is positioned to operate outside of the rolling track of the power roller so that the auxiliary roller 10 may be operated up against buildings or curbs that are higher than the lower end of the skirt 24 of the power roller 12. As illustrated in FIG. 2, the axle of the roller 10 is attached to a vertical steel block 26 that preferably has a rectangular cross-section. The hydraulic piston shaft 28 associated with hydraulic cylinder 14 is rigidly attached to the top end of a block 26 and the bracket 19 is welded or otherwise rigidly attached to the side of the block 26 that faces the power roller 12 when auxiliary roller 10 is in its operating position, as illustrated in FIG. 3.

As best illustrated in FIGS. 3 and 3-A, the bracket 19 is provided at its end with a steel cross member 30 which, during operation of the auxiliary roller, loosely fits within a mating socket 32 that is rigidly attached to the power roller 12 as illustrated in FIG. 1. Thus, as the hydraulic cylinder 14 is operated by an external hydraulic pressure source to apply vertical adjustment to the auxiliary roller 10, the T-bar bracket 19 is permitted to slide in the socket 20 to thereby properly align the auxiliary roller 10 and also to prevent the roller 10 and its associated mounting equipment from being pivoted about the pivot bolt 18 during operation. The T-bar bracket 19 sliding within the socket 20 therefore maintains proper alignment of the auxiliary roller 10 and also maintains substantially a vertical alignment of the cylinder 14.

As illustrated in FIG. 1, the auxiliary roller 10 may, if desired, be withdrawn from its operating position behind the power roller by merely contracting the hydraulic cylinder 14 to lift the auxiliary roller 10 and therefore the slidable T-bar bracket 19 from the socket 20. The roller and its associated mounting hardware may then be pivoted up about the pivot bolt 18 as indicated by the dashed line 34 and, after being rotated 180°, the T-bar bracket 19 may then engage a storage socket 36 that is similar to the socket 20 and which is supported on the body of the power roller 12 by a suitable bracket 38. The auxiliary roller 10 is thus removed out of the way of the power roller 12 until such time as it is necessary to roll a surface adjacent to a building or to a curb that is higher than the skirt 24 of power roller 12.

FIG. 4 is a sectional view of the interior of the auxiliary roller 10 and illustrates the steel block 26 which rigidly supports the roller axle 40. At the end of axle 40 is a bearing assembly 42 having a circular flanged member 44. The auxiliary roller, which may have a diameter of ten or twelve inches, is tubular and centrally located within the interior of the roller 10 is an annular disc 46 that is rigidly welded to the roller interior walls and which contains a large central aperture and a plurality of surrounding holes that are aligned with similar holes in the flange 44. Suitable bolts or lugs are then used to rigidly fasten the disc 46, and therefore the roller 10, to the flange 44, and therefore to axle 40. The bearing assembly 42 and flange 44 is preferably made from an automotive wheel bearing assembly containing suitable lug bolts extending through the wheel flange to mate with the holes in the interior disc 46.

FIGS. 5 and 6 illustrate a second embodiment particularly useful for use on large power rollers which are not readily maneuverable in close areas such as in close proximity to a building. In the embodiment illustrated in FIGS. 5 and 6, the auxiliary roller 50 and its associated vertical hydraulic cylinder 52 and slidable T-bar bracket 54 are mounted to a support structure having a track assembly which permits horizontal side motion of the roller 50. The track assembly comprises a top rail 56 and a lower rail 58 both being parallel with each other and with the axis of the roller 50. The tracks 56 and 58 are preferably steel bars or tubing having rectangular cross-sections. Mounted to the top and lower rails 56 and 58 is a support bracket assembly 60 having upper and lower sockets that loosely engage the top and lower rails 56 and 58, respectively, so that the support bracket assembly 60 may freely move horizontally along the rails. Extending outwardly from the top of the assembly 60 is a support bracket 62 which pivotally supports the hydraulic cylinder 52. At the end of the lower rail 58 that is opposite the end adjacent the auxiliary roller 50 is an extension bracket 64 which pivotally supports a lateral motion hydraulic cylinder 66, the piston shaft of which pivotally engages a clevis 68 attached to the steel block 70 on the surface opposite the auxiliary roller axle 72. The entire assembly, including the roller 50 and all of its associated mounting structure such as the top and lower rails 56 and 58, is rigidly attached by suitable mounting brackets to the end of the power roller or other vehicle with which it is to be used.

FIG. 6 illustrates in better detail the end bracket 64, the lateral motion hydraulic cylinder 66 and its connection to the steel block 70 which carries the axle 72 and the slidable T-bar bracket 54 which, in operation, fits within the socket 74 that is welded to the assembly 60.

In operation, the roller 50 may be adjusted in a vertical direction by actuation of the vertical hydraulic cylinder 52 by an external pressure source not part of the invention and the roller 50 may be properly adjusted next to a curb or building by actuation of the lateral motion cylinder 66 which operates to move the entire assembly 60, together with the vertical cylinder 52 and the roller 50 along the tracks 56 and 58. During periods that the auxiliary roller 50 is not in use, the hydraulic pistons in both the cylinders 52 and 66 are withdrawn to position the roller 50 above the ground surface and behind the associated power roller.

Having thus described my invention, what is claimed is:

1. An auxiliary roller accessory system for a vehicle for rolling a surface outside of the normal rolling track of said vehicle, said roller accessory system comprising:

a support structure rigidly mountable to the rear body of the vehicle, said support structure including a support bracket extending outwardly from said vehicle;

a hydraulically operable cylinder pivotally connected to the end of said bracket distal of said vehicle, said cylinder having a movable piston;

a roller having an axle coupled to said piston, said roller being movable in a vertical direction upon hydraulic actuation of said piston;

a slidable bracket having a first end connected to said roller axle and a second end having a connected cross member; and socket means coupled to said vehicle and positioned to loosely engage the cross member on said slidable bracket for maintaining both the rolling alignment of said roller and the substantially vertical alignment of said hydraulic cylinder.

2. The system claimed in claim 1 whereby said roller is tubular and includes a centrally positioned annular disc rigidly attached to the interior wall and in a plane normal to the longitudinal axis of said roller, said disc being bolt mounted to a bearing assembly connected to said roller axle.

3. The system claimed in claim 2 wherein said bearing assembly is an automotive wheel bearing assembly.

4. The system claimed in claim 2 further including a second socket means mounted to said vehicle at a point above said support bracket for engaging said slidable bracket cross member and for retaining said auxiliary roller in a non-operating storage position.

5. The system claimed in claim 2 wherein said support structure includes an upper and lower track, said tracks being horizontal, and parallel of each other and with the rotational axis of said roller, said support bracket being slidable along said upper and lower tracks for lateral adjustment of said roller.

6. The system claimed in claim 5 further including a lateral motion hydraulic cylinder pivotally coupled between said auxiliary roller and the end of said support structure distal of said auxiliary roller for lateral horizontal adjustment of said support bracket and said roller.

* * * * *